US007556048B2

(12) United States Patent
Olmer et al.

(10) Patent No.: US 7,556,048 B2
(45) Date of Patent: Jul. 7, 2009

(54) IN-SITU REMOVAL OF SURFACE IMPURITIES PRIOR TO ARSENIC-DOPED POLYSILICON DEPOSITION IN THE FABRICATION OF A HETEROJUNCTION BIPOLAR TRANSISTOR

(75) Inventors: Leonard J. Olmer, Orlando, FL (US); Robert F. Jones, Clermont, FL (US); William D. Bevers, Orlando, FL (US); Edward P. Martin, Jr., Orlando, FL (US)

(73) Assignee: Agere Systems Inc., Allentown, PA (US)

( * ) Notice: Subject to any disclaimer, the term of this patent is extended or adjusted under 35 U.S.C. 154(b) by 208 days.

(21) Appl. No.: 10/675,575

(22) Filed: Sep. 30, 2003

(65) Prior Publication Data

US 2004/0123882 A1 Jul. 1, 2004

Related U.S. Application Data

(60) Provisional application No. 60/426,842, filed on Nov. 15, 2002.

(51) Int. Cl.
*B08B 6/00* (2006.01)

(52) U.S. Cl. ..... 134/1.2; 134/1.3; 134/26; 134/30; 438/761

(58) Field of Classification Search ..... 134/2, 134/3, 19, 25.4, 26, 28, 41, 902, 37, 1.2, 134/1.3, 30; 427/523; 438/761
See application file for complete search history.

(56) References Cited

U.S. PATENT DOCUMENTS

| | | | | |
|---|---|---|---|---|
| 4,752,505 | A * | 6/1988 | Arac | 438/750 |
| 4,845,043 | A * | 7/1989 | Catalano | 438/93 |
| 5,620,559 | A * | 4/1997 | Kikuchi | 438/723 |
| 5,963,840 | A * | 10/1999 | Xia et al. | 438/783 |
| 6,024,045 | A * | 2/2000 | Kikuchi et al. | 118/723 ME |
| 6,336,463 | B1 * | 1/2002 | Ohta | 134/61 |
| 6,350,322 | B1 * | 2/2002 | Yates | 134/3 |
| 6,492,283 | B2 * | 12/2002 | Raaijmakers et al. | 438/770 |
| 6,690,040 | B2 * | 2/2004 | Chaudhry et al. | 257/135 |
| 2002/0098627 | A1 * | 7/2002 | Pomarede et al. | 438/149 |
| 2004/0043570 | A1 * | 3/2004 | Fujisaki et al. | 438/287 |

* cited by examiner

*Primary Examiner*—Michael Barr
*Assistant Examiner*—Jason Heckert

(57) ABSTRACT

A process for cleaning the silicon surface of a semiconductor device material layer. The surface undergoes a pre-clean process followed by exposure to a nitrogen-containing gas. A polysilicon layer is formed on the surface in the same chamber and at about the same temperature as the cleaning and nitrogen exposing steps.

28 Claims, 7 Drawing Sheets

IN-SITU REMOVAL OF SURFACE IMPURITIES PRIOR TO ARSENIC-DOPED POLYSILICON DEPOSITION IN THE FABRICATION OF A HETEROJUNCTION BIPOLAR TRANSISTOR

This application claims the benefit of provisional patent application Ser. No. 60/426,842 filed on Nov. 15, 2002.

FIELD OF THE INVENTION

The present invention relates generally to the fabrication of heterojunction bipolar transistors, and more specifically to the removal of certain surface impurities formed during a fabrication process.

BACKGROUND OF THE INVENTION

Heterojunction bipolar transistors (HBT's) are now widely used in applications where high switching speeds and high frequency operation are desired. The emitter in an HBT has a wider band gap than the band gap of the base, thus creating an energy barrier in the valence band at the emitter-base junction that inhibits the unwanted flow of holes from the base region to the emitter region. Since there is substantially no injection of minority carriers from the base into the emitter, the base impurity concentration can be increased, while maintaining the emitter injection efficiency at a relatively high level. Therefore, it is possible to narrow the base width and lower the internal base resistance, improving the current gain, the emitter injection efficiency and operating cut-off frequency of the transistor, as compared with a conventional bipolar transistor. Progress in epitaxial growth technology of compound semiconductors has fueled the development of HBT's.

FIG. 1 illustrates an HBT 10. A silicon-germanium (SiGe) layer 12 overlies a silicon substrate 14 between two silicon dioxide spacers 16. In stacked relation, the HBT comprises a collector, base, and emitter. A base polysilicon layer 18 forms a contact with the base region 19 of the SiGe layer 12 and is further connected to a base contact, not shown in FIG. 1, for accessing the base region. A silicon nitride layer 22A, silicon nitride spacers 22B, silicon nitride spacers 24 and silicon dioxide spacers 26 separate an arsenic-doped polysilicon layer 30 from the base polysilicon layer 18. A buried doped layer (not shown in FIG. 1) within the silicon substrate 14 contacts the collector region, which is disposed at the bottom of the SiGe layer 12, and further is connected to a contact for providing access to the collector.

The process for forming the HBT 10 is illustrated beginning in FIG. 2, showing a stack 38 comprising a silicon dioxide layer 40 (formed preferably by a TEOS (tetraethyl orthosilicate) process), a base polysilicon layer 42, a silicon-nitride layer 44 and an silicon dioxide cap layer 46. The base polysilicon layer 42 is doped p-type prior to formation of the silicon-nitride layer 44.

In the next process step as illustrated in FIG. 3, a window 50 is etched in the stack 38, stopping on an upper surface 54 of the silicon dioxide layer 40. Conventional photolithographic patterning and masking steps, followed by an etch process, are used to form the window 50. As a result of this etching process, the base polysilicon layer 18 and the silicon nitride layer 22A of FIG. 1 are formed on opposing sides of the window 50.

A silicon-nitride layer 58 is formed (see FIG. 4) on the field region 59 and within the window 50. After etching, only the spacers 22B remain. See FIG. 5.

Next an emitter window 66 is formed by etching a region of the silicon dioxide layer 40, as illustrated in FIG. 6, forming the silicon dioxide spacers 16 on opposing sides of the emitter window 66. Regions 67 of the emitter window 66 undercuts the base polysilicon layer 42 as shown.

The SiGe layer 12 is then formed epitaxially on the silicon substrate 14. See FIG. 7. Preferably the SiGe layer 12 comprises in stacked relation from the bottom, a spacer layer, a graded base region (where the Ge doping concentration is graded from the doping in the spacer layer down to about zero) and a silicon cap layer. Boron is introduced into the chamber atmosphere during formation of the base region and the silicon cap layer to form the p-type base. The collector region is formed within the spacer layer by the diffusion of phosphorous from the silicon substrate 14 upwardly into the spacer region of the SiGe layer 12.

A TEOS oxide deposition forms a silicon dioxide layer 70 followed by the deposition of a silicon-nitride layer 72 as depicted in FIG. 8. Both the silicon dioxide layer 70 and the silicon-nitride layer 72 are etched to form the silicon dioxide spacers 26 and the silicon nitride spacers 24 as illustrated in FIG. 9.

According to the prior art, the process continues with a plasma cleaning step in an oxygen and nitrogen atmosphere, followed by a wet or solvent clean. Both steps are intended to remove impurities on a surface 80 of the SiGe layer 12 prior to formation of the arsenic-doped polysilicon layer 30 illustrated in FIG. 1. Immediately prior to deposition of the layer 30, the wafer undergoes a pre-clean step in which it is subjected to an HF atmosphere, an HF dip, an RCA clean (a two-step clean using hydrogen peroxide in both steps), and an in situ HF dip and isopropyl alcohol dry. The final in situ HF dip and isopropyl alcohol dry removes any chemical oxides grown during the RCA clean step and forms a hydrogen terminated silicon surface. A hydrogen terminated silicon surface is known to resist native oxide formation in a normal atmosphere at room temperature, presenting a relatively clean surface 80 for execution of the next process step.

The arsenic-doped polysilicon layer 30 is deposited over the FIG. 9 structure to substantially complete formation of the HBT 10 as illustrated in FIG. 1. The arsenic-doped polysilicon layer 30 undergoes solid phase epitaxial growth after subsequent thermal processing. Arsenic is diffused from the arsenic-doped polysilicon layer 30 to form the emitter within the SiGe layer 12.

In certain fabrication processes, formation of the arsenic-doped polysilicon layer 30 is performed in a lamp-based deposition tool wherein the tool chamber is heated to about 700° C. by radiant energy prior to and during the deposition process while maintaining a hydrogen flow through the tool chamber. The hydrogen flow maintains the surface 80 in a relatively clean condition during the deposition.

It is known that other tools can be used to deposit the arsenic-doped polysilicon layer 30, including a hot plate tool wherein the wafer is heated through physical contact with a resistively heated chuck. The hot-plate tool offers certain advantages relative to the lamp-based process for depositing the layer 30, including a more uniform material deposition (thus improving the electrical properties of the final device) and higher wafer through-put. The hot-plate process is performed at about 700° C. with a nitrogen flow through the tool chamber both before and during deposition of the arsenic-doped polysilicon layer 30 on the surface 80. It is known that a silicon surface can loose the hydrogen termination condition upon heating. Therefore, the surface 80 is likely contaminated with impurities from the hot plate deposition system or impurities present in the nitrogen gas flow during a temperature stabilization step performed at about 700° C. while maintaining a nitrogen flow, before initiating formation of the arsenic-doped polysilicon layer 30.

It has been determined that fabrication of the layer 30 using the hot plate tool as described above, causes unwanted surface impurities on the surface 80. The observed impurities include oxygen, carbon and nitrogen. It is desired to remove these impurities prior to formation of the arsenic-doped polysilicon layer 30, as they disadvantageously increase the emitter resistance. The impurities also degrade the purity and modify the grain structure of the layer 30 during the subsequent solid phase epitaxial growth, contributing to an increase in the emitter resistance. The impurities can also affect the arsenic diffusion profile in the silicon cap layer.

One known technique for removing these impurities includes a hydrogen bake, i.e., subjecting the wafer to high temperature hydrogen environment. However, an in-situ high temperature hydrogen bake is impractical while using the hot plate system. The maximum operating temperature for the hot plate system is 800° C. Because the hot plate has high the thermal mass, the thermal recovery time from 800° C. to 700° C. (the temperature stabilization step) is very long (i.e., greater than fifteen minutes). Although the hydrogen bake process tends to remove some of the impurities, further improvements are warranted.

SUMMARY OF THE INVENTION

The present invention describes a process for removing contaminants from a surface during fabrication of a semiconductor device of an integrated circuit. The process comprises cleaning the surface, forming a hydrogen termination on the surface, and cleaning the surface with a nitrogen-containing gas at a relatively low temperature.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different figures. The drawings are not necessarily to scale, emphasis instead being placed upon illustrating the principles of the invention.

DETAILED DESCRIPTION OF THE INVENTION

Figure 1:
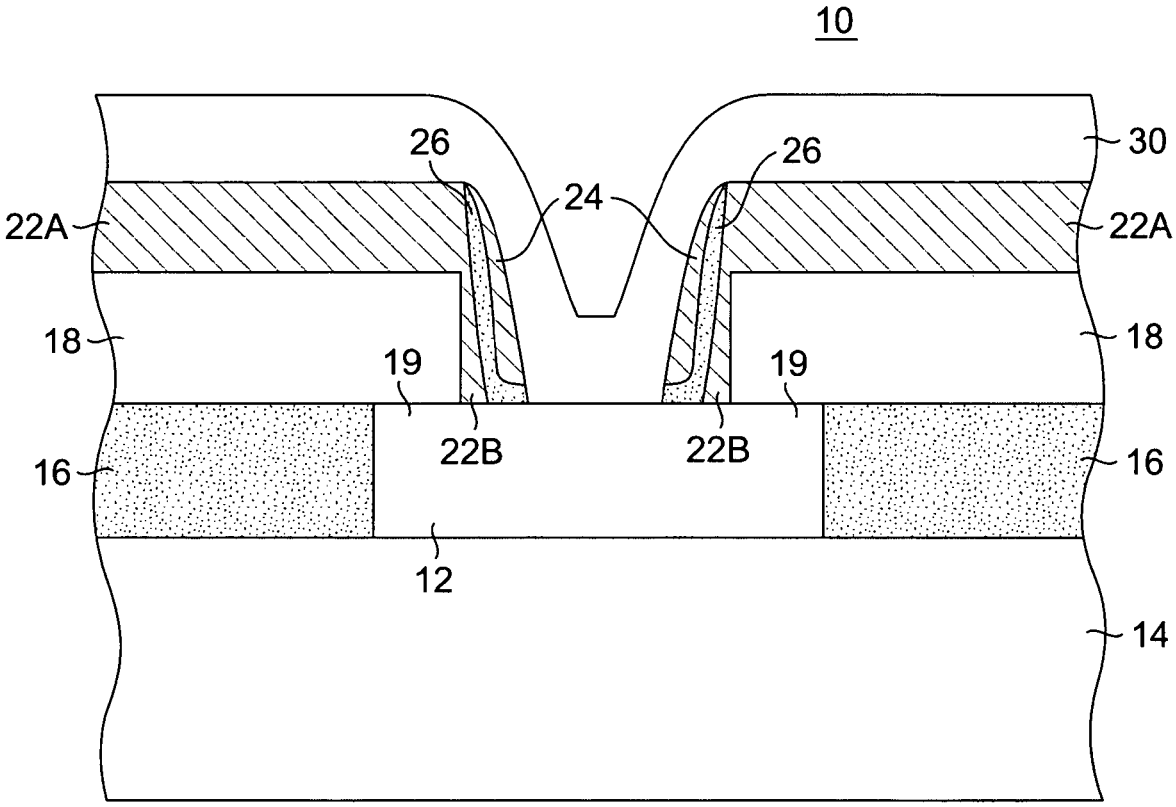
FIG. 1 is a cross-sectional view of an HBT to which the teachings of the present invention can be applied.
Figure 2:
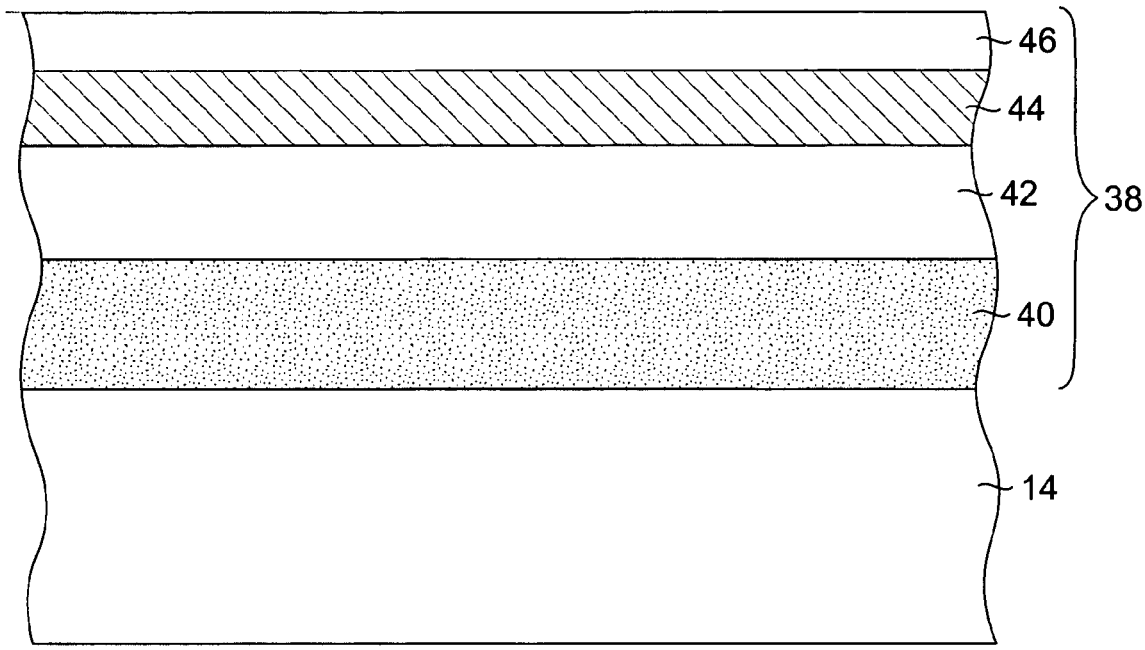
FIGS. 2-9 illustrate the fabrication steps for forming the HBT of FIG. 1.
Figure 3:
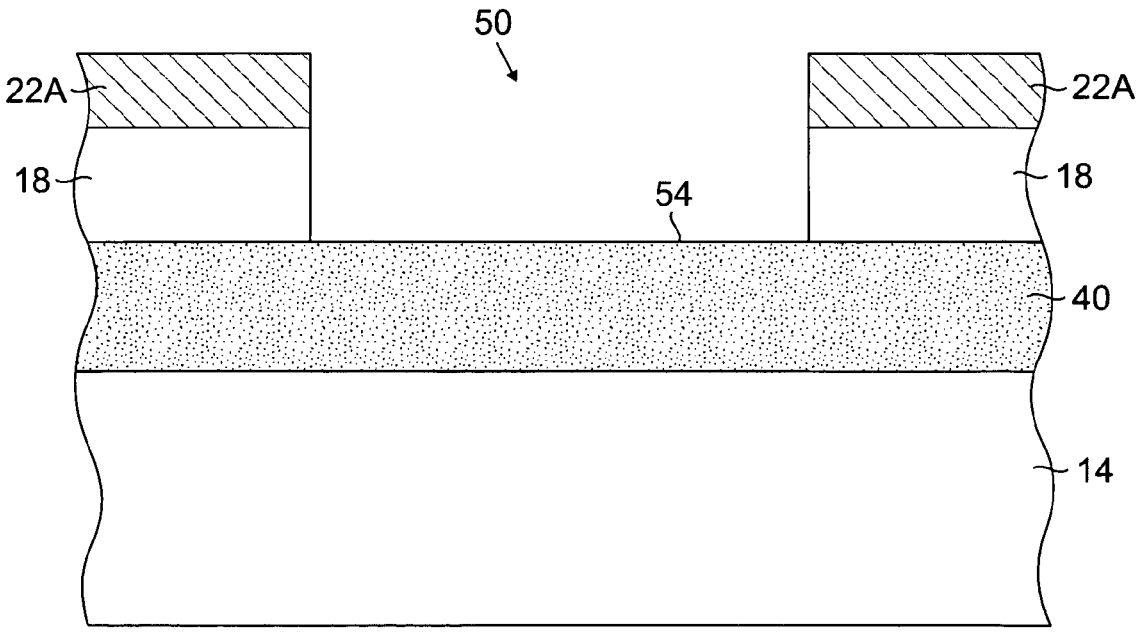
Figure 4:
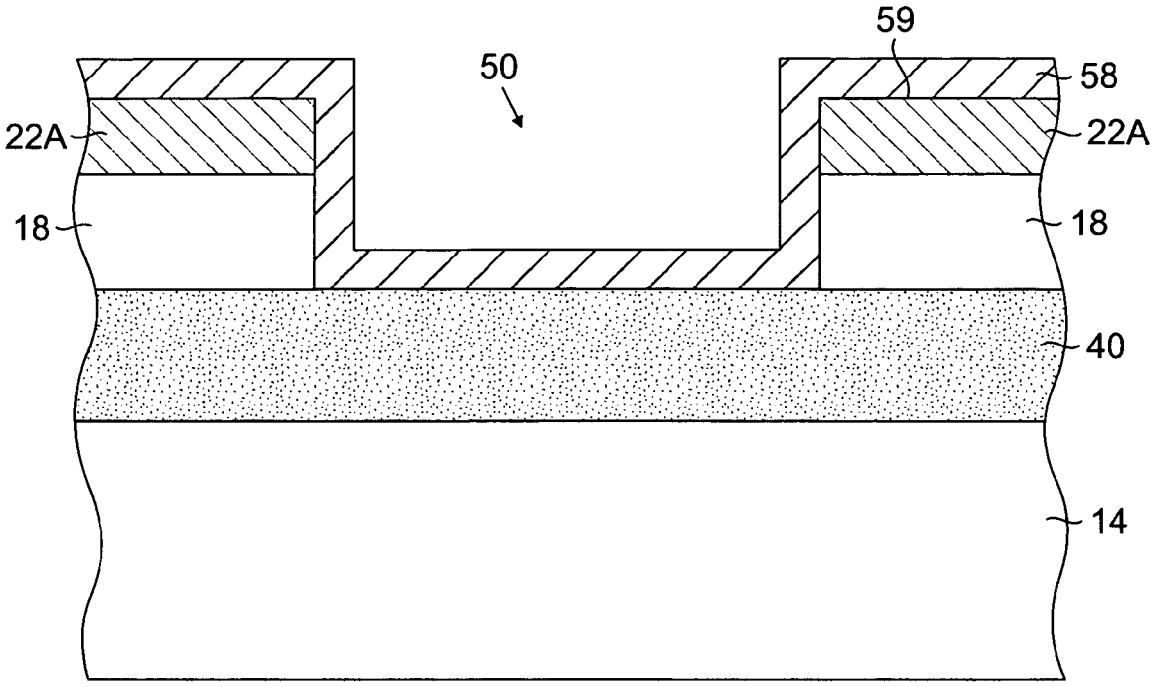
Figure 5:
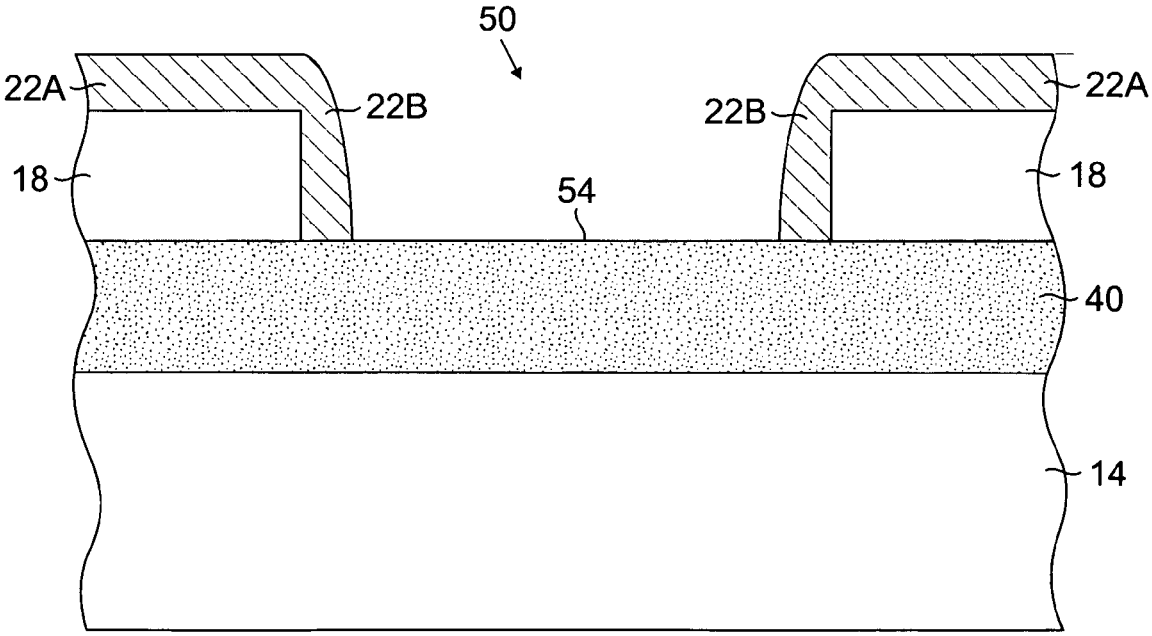
Figure 6:
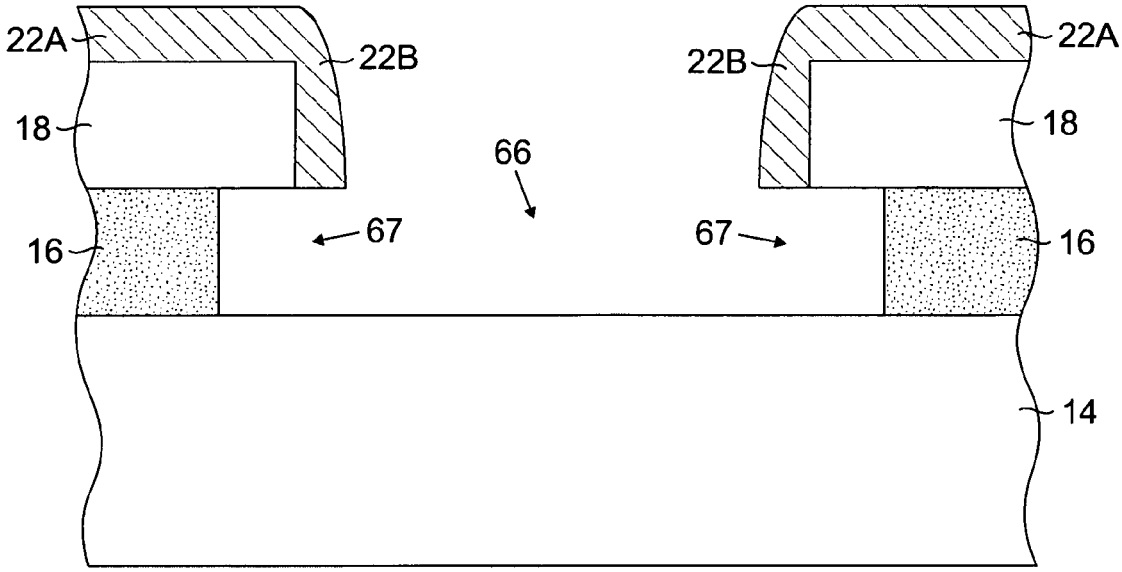
Figure 7:
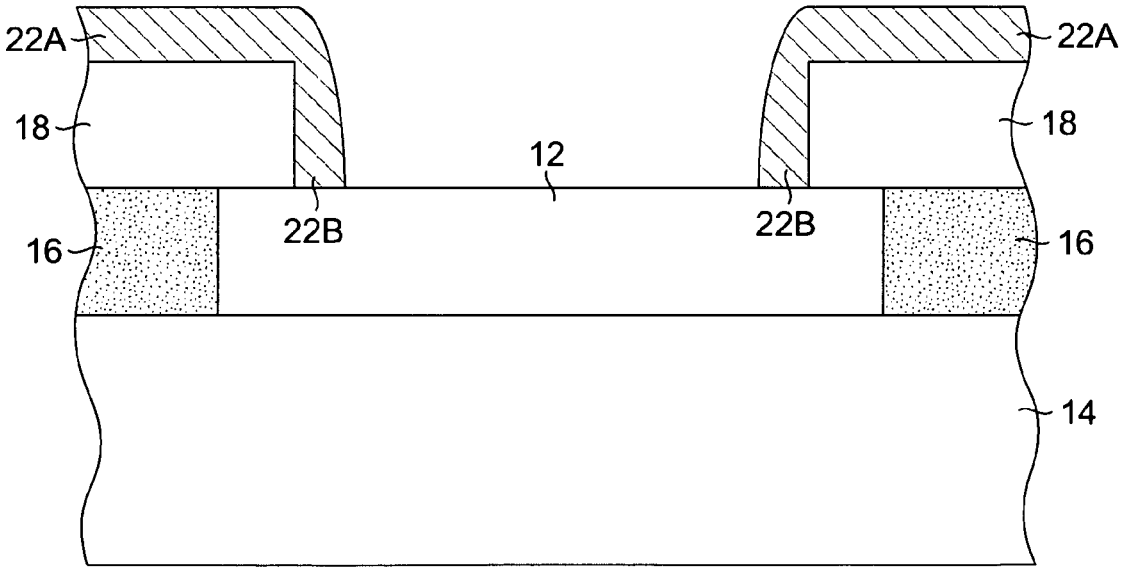
Figure 8:
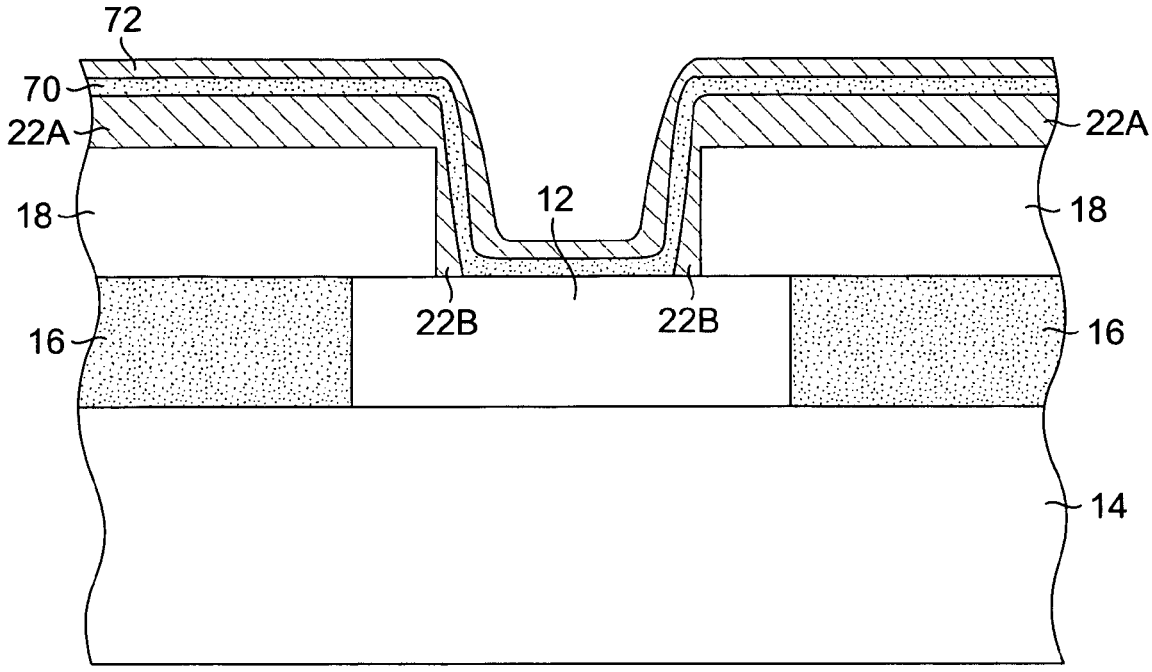
Figure 9:
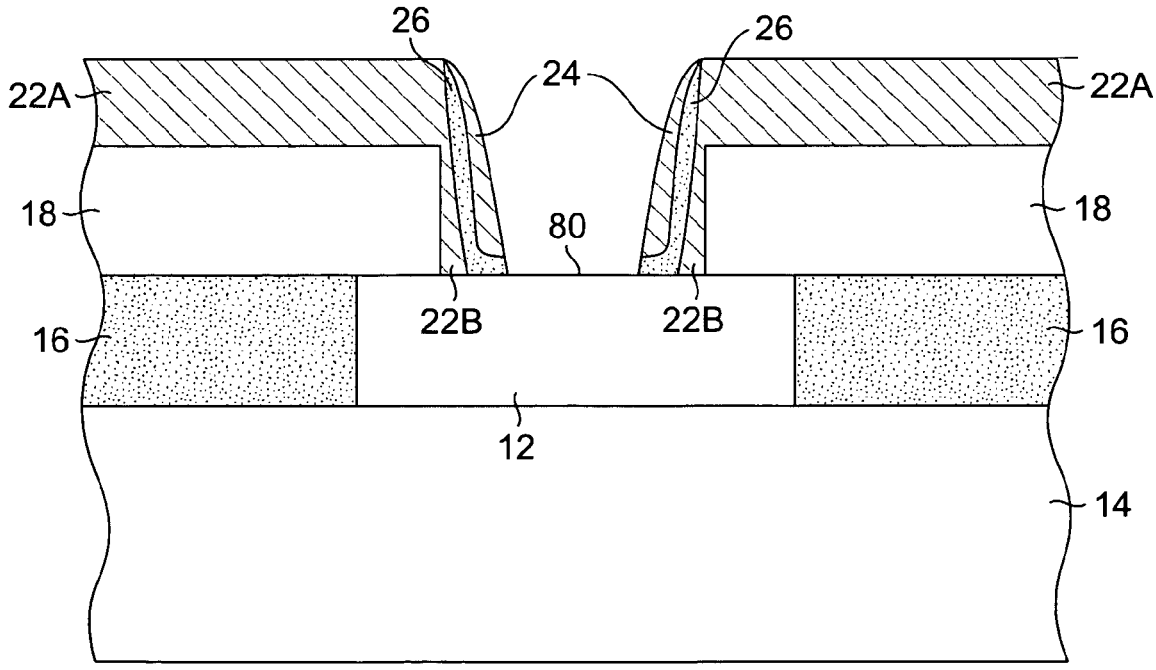

Before describing in detail the particular process for removing surface impurities during fabrication of the arsenic doped polysilicon emitter in an HBT, in accordance with the teachings of the present invention, it should be observed that the present invention resides primarily in a novel combination of method steps. Accordingly, the process steps have been represented by conventional elements in the drawings, showing only those specific details that are pertinent to the present invention, so as not to obscure the disclosure with structural details that will be readily apparent to those skilled in the art having the benefit of the description herein.

The present invention relates to the use of an in-situ cleaning method to reduce the level of contamination (especially carbon and oxygen contaminants) on a silicon surface prior to the subsequent deposition of doped (e.g., with arsenic, boron, phosphorous or another dopant) or un-doped polycrystalline silicon layer on a doped or un-doped silicon substrate (i.e., bulk silicon or epitaxial silicon).

One application for use of the present invention is prior to deposition of an arsenic-doped polycrystalline silicon layer, which serves as the emitter contact polysilicon in a silicon germanium (SiGe) graded base NPN bipolar transistor. The SiGe epitaxial structure can be grown by a selective epitaxy process or by a non-selective process. In the SiGe process the germanium concentration is graded from a high level on the collector side of the base to a low level on the emitter side of the base. In one embodiment of a process for forming the SiGe graded base transistor, the selective SiGe epitaxial structure comprises a SiGe spacer layer (un-doped), a SiGe graded base layer (in one embodiment boron doped), and a silicon cap layer (boron doped in one embodiment). The NPN transistor is formed by subsequent arsenic diffusion from the arsenic-doped polycrystalline layer through the silicon cap layer into the SiGe graded base layer. The collector is formed by phosphorous diffusion from an underling substrate through the SiGe spacer layer into the SiGe graded base.

Another exemplary application is prior to deposition of an arsenic-doped polycrystalline silicon layer, which serves as the emitter contact in a silicon germanium (SiGe) heterojunction (HBT) NPN bipolar transistor. As with the graded base NPN bipolar transistor, the SiGe HBT epitaxial structure can be grown by a selective epitaxy process or by a non-selective process. In the SiGe HBT transistor the germanium concentration is high and nominally uniform across the base layer. In one embodiment, the selective SiGe HBT epitaxial structure comprises an upper SiGe spacer layer (un-doped), a SiGe base layer (boron doped in one embodiment), a lower SiGe spacer layer (un-doped) and the arsenic-doped silicon emitter layer. The NPN transistor is formed by subsequent arsenic diffusion from the arsenic-doped emitter layer into the upper SiGe spacer layer, boron diffusion from the SiGe base layer into both the upper and the lower SiGe spacer layers, and phosphorous diffusion from a substrate into the lower SiGe spacer layer. Arsenic also diffuses from the arsenic-doped polycrystalline layer into the arsenic-doped silicon emitter layer, reducing the emitter resistance.

The present invention teaches several variants of cleaning processes for removal of the impurities on the surface 80 prior to deposition of the arsenic-doped polysilicon layer 30. Certain of the embodiments comprise a cleaning step with NF3 (nitrogen fluoride) at different flow rates, and certain embodiments further comprise a hydrogen bake step. Advantageously, the NF3 clean and the hydrogen bake steps can be performed within the same chamber where the arsenic-doped polysilicon layer 30 is deposited, at about the same pressure as the deposition process and within a temperature range of the deposition temperature. Thus the process of the present invention is referred to as in-situ clean process.

Figure 10:
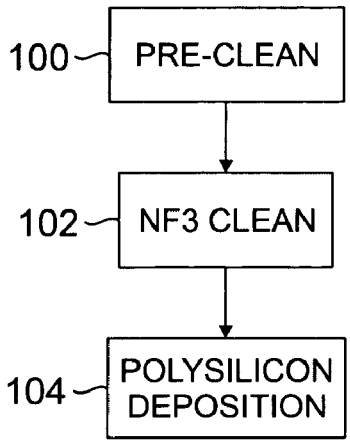
FIGS. 10-15 depict process steps according to the teachings of the present invention.

In a first embodiment illustrated in FIG. 10, the device undergoes a pre-clean step 100, including an HF dip, an RCA clean (a two-step clean using hydrogen peroxide in both steps), and an in-situ HF dip and isopropyl alcohol dry to remove any chemical oxides grown during the RCA clean step and to form a hydrogen terminated surface on the surface 80.

At a step 102 the device is subjected to an NF3 clean step at a temperature of between about 500° C. and about 800° C. (a temperature of about 700° C. is preferred) for a duration of between about 20 and 80 seconds at a flow rate of about 75 sccm. A preferred duration is about 20 seconds. The pressure during the NF3 clean step is about 275 Torr.

The arsenic-doped polysilicon layer 30 is then deposited at a temperature of about 700° C. and a pressure of about 275 Torr, as depicted by a step 104.

Figure 11:
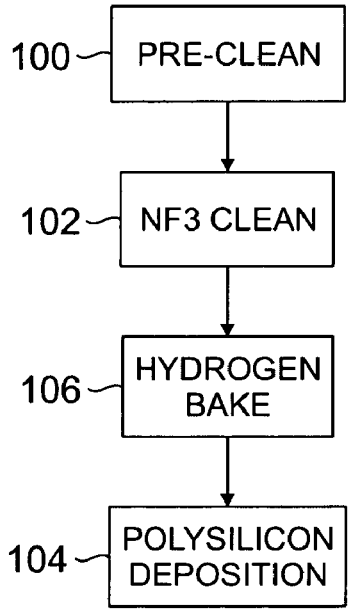

In the embodiment of FIG. 11, a hydrogen bake step 106 is added between the NF3 clean step 102 and the deposition step 104. Hydrogen is supplied to the processing chamber for about 60 to 90 seconds at about 700° C. Although the NF3 removes carbon and oxides from the surface 80, it may leave behind a fluorine contaminant. The hydrogen bake step substantially removes any fluorine.

Figure 12:
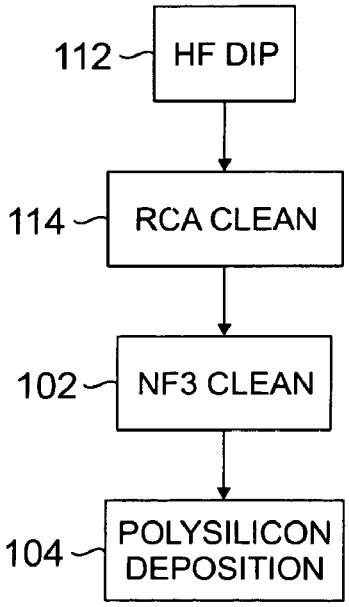

In the FIG. 12 embodiment, the pre-clean process is separated into individual constituent steps, i.e., the HF dip at a step 112 and the RCA clean at a step 114. The NF3 clean at the step 102 removes chemical oxides deposited on the surface 80 during the RCA cleaning step, and thus the in-situ HF dip step and isopropyl alcohol dry step referred to in conjunction with FIG. 10 are not necessary. Following the NF3 clean step 102, the arsenic-doped polysilicon layer 30 is deposited at the step 104.

Figure 13:
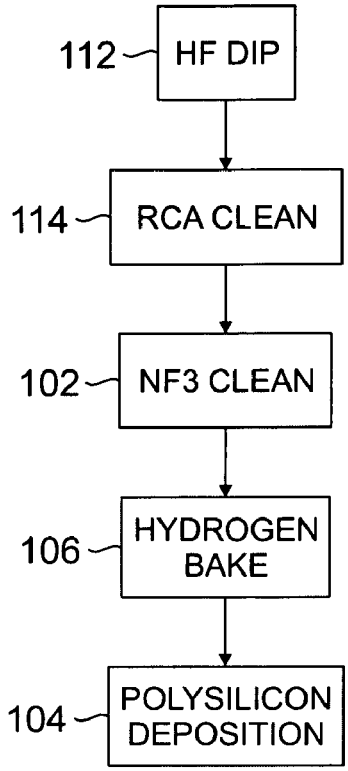

The FIG. 13 embodiment is similar to the FIG. 12 embodiment, and includes the hydrogen bake step 106 immediately preceding deposition of the arsenic-doped polysilicon layer 30.

Figure 14:
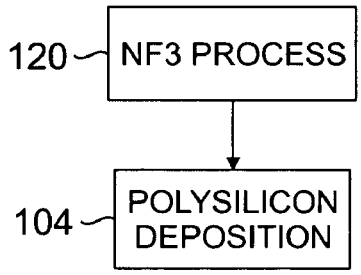
Figure 15:
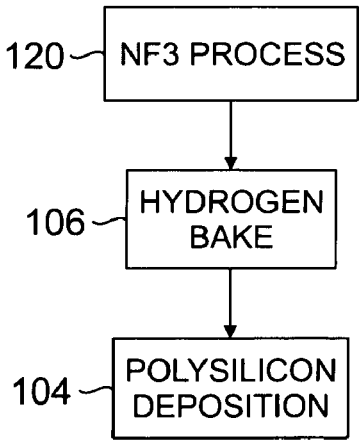

In the embodiments represented by the FIGS. 14 and 15 process flowcharts, the pre-clean step 100 included in previous embodiments is replaced by an NF3 process 120 that serves to both clean the surface 80 and etch oxides, carbon and nitrogen that have formed there during previous process steps. This NF3 process is conducted at a flow rate of about 200 sccm. The FIG. 15 embodiment includes the hydrogen bake step 106 between the NF3 process 120 and deposition of the arsenic-doped polysilicon layer 30 at the step 104.

The various embodiments of the present invention can be practiced with the formation of the in situ arsenic-doped polysilicon layer 30 as described herein, and with a process employing implant doping after depositing an un-doped polysilicon layer.

Although explained with reference to the deposition of a polysilicon doped emitter region of an HBT, the teachings of the present invention can be applied more generally to the deposition of doped and un-doped polysilicon over a doped or un-doped epitaxially grown layer or a doped or un-doped bulk silicon substrate. For example, the method according to the teachings of the present invention can be employed to clean an epitaxial or bulk silicon surface prior to the deposition of doped or un-doped polycrystalline silicon in a contact window to form a polysilicon contact with the epitaxial or bulk silicon.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A process for removing contaminants from a surface of a first material layer during fabrication of an integrated circuit prior to depositing a second material layer thereover, the process comprising steps of:

(a) cleaning the surface;

(b1) forming a hydrogen termination on the surface;

(b2) stabilizing the surface at about 700° C. through physical contact with a hot plate and with a flow of nitrogen gas in a deposition chamber, wherein contaminants are formed on the surface from the hot plate or the nitrogen gas;

(c1) exposing the surface to a nitrogen-containing gas comprising nitrogen fluoride at a temperature of between about 500° C. and 800° C. and pressure of about 275 Torr to remove the contaminants from the surface;

(c2) exposing the surface to a high temperature hydrogen bake, wherein step c2 is done between exposing the surface to the nitrogen-containing gas and depositing the second material layer;

(d) depositing the second material layer within the temperature range of the step (c1); and (e) wherein the steps (c) and (d) are performed in a single deposition chamber.

2. The process of claim 1 wherein the surface comprises a surface of a material layer selected from among a doped epitaxial material, an un-doped epitaxial material, a doped bulk silicon substrate and an un-doped bulk silicon substrate.

3. The process of claim 1 wherein the a step (a) further comprises:

(a1) subjecting the surface to an HF dip; and (a2) cleaning the surface using an RCA cleaning process.

4. The process of claim 1 wherein the step (b1) further comprises:

(b3) subjecting the surface to an HF dip; and (b4) drying the surface with isopropyl alcohol.

5. The process of claim 1 wherein the hot plate is a resistively heated chuck.

6. The process of claim 1 wherein a duration of the step (c1) is between about 20 seconds and 80 seconds.

7. The process of claim 1 wherein the step (c1) is practiced at about 700° C. for a duration of about 20 seconds at a flow rate of about 75 sccm.

8. The process of claim 1 wherein the second material layer is selected from between a doped polysilicon material and an un-doped polysilicon material.

9. The process of claim 1 wherein the steps (a), (b1), (c1) and (d) are performed in a single chamber.

10. The process of claim 1 wherein during execution of the steps (a), (b1), (c1) and (d) a pressure is maintained at a relatively constant value.

11. The process of claim 1 wherein the step (c2) comprises supplying hydrogen for a duration of about 60 to 90 seconds at a temperature of about 700° C.

12. The process of claim 1 wherein the second material layer is selected from between a doped polysilicon material and an un-doped polysilicon material.

13. The process of claim 1 wherein the steps (a) through (d) are performed in-situ.

14. The process of claim 1 wherein the second material layer comprises an arsenic-doped polysilicon material.

15. A process for removing contaminants from a surface of a semiconductor device during fabrication of an integrated circuit, comprising steps of:

(a1) stabilizing the surface at about 700° C. through physical contact with a hot plate and with a flow of nitrogen gas in a deposition chamber, wherein contaminants are formed on the surface from the hot plate or the nitrogen gas;

(a2) exposing the surface to a nitrogen-containing gas comprising nitrogen fluoride at a temperature range of between about 500° C. and 800° C. and pressure of about 275 Torr and at a flow rate to remove contaminants from the surface;

(a3) subsequent to exposing the surface to the nitrogen-containing gas, exposing the surface to a high temperature hydrogen bake; and (b) depositing a polysilicon layer on the post-hydrogen-baked surface in situ within the temperature range.

16. The process of claim 15 wherein the hot plate is a resistively heated chuck.

17. The process of claim 15 wherein a duration of the step (a2) is between about 20 seconds and 80 seconds.

18. The process of claim 15 wherein the step (a2) is practiced at about 700° C. for a duration of about 20 seconds at a flow rate of about 200 sccm.

19. The process of claim 15 wherein the surface comprises a surface of a material layer selected from among a doped epitaxial material, an un-doped epitaxial material, a doped bulk silicon substrate and an un-doped bulk silicon substrate.

20. The process of claim 15 wherein the polysilicon layer is selected from between a doped polysilicon material and an un-doped polysilicon material.

21. The process of claim 15 wherein the steps (a2) and (b) are practiced at about an equivalent pressure.

22. The process of claim 15 wherein the polysilicon layer comprises an arsenic-doped polysilicon material.

23. The process of claim 15 wherein the step (a2) further comprises (a4) exposing the surface to the nitrogen-containing gas at a flow rate of about 200 sccm to remove contaminants from the surface.

24. The process of claim 15 wherein the hydrogen bake comprises supplying hydrogen for a duration of about 60 to 90 seconds at a temperature of about 700° C.

25. The process of claim 23 wherein the polysilicon layer is selected from between a doped polysilicon material and an un-doped polysilicon material.

26. The process of claim 23 wherein the steps (a4) and (a5) are performed in-situ.

27. A process for removing contaminants from a surface of a first material layer having a SiGe layer during fabrication of an integrated circuit prior to depositing a second material layer having an As-doped polysilicon layer thereover, the process comprising steps of:

(a) cleaning the surface;

(b) forming a hydrogen termination on the surface;

(b2) stabilizing the surface at about 700° C. through physical contact with a hot plate and with a flow of nitrogen gas in a deposition chamber, wherein contaminants are formed on the surface from the hot plate or the nitrogen gas;

(c1) exposing the surface to a nitrogen-containing gas at a temperature of between about 500° C. and 800° C. and pressure of about 275 Torr to remove the contaminants from the surface;

(c2) exposing the surface to a a high temperature hydrogen bake, wherein step c2 is performed between exposing the surface to the nitrogen-containing gas and depositing the second material layer;

(d) depositing the second material layer within the temperature range of the step (c1); and (e) wherein the steps (c1) and (d) are performed in a single deposition chamber.

28. The process of claim 1, wherein step (b2) is performed during the step (d).

* * * * *